United States Patent [19]

Zide

[11] 4,455,686

[45] Jun. 26, 1984

[54] PROTECTIVE LEG PADDING FOR ATHLETIC PANTS

[75] Inventor: Robert M. Zide, Williamstown, W. Va.

[73] Assignee: Pro-Line, Inc., Marietta, Ohio

[21] Appl. No.: 467,213

[22] Filed: Feb. 17, 1983

[51] Int. Cl.[3] ..... A41D 13/06

[52] U.S. Cl. ..... 2/23

[58] Field of Search ..... 2/22-24, 2/2

[56] References Cited

U.S. PATENT DOCUMENTS

| | | | |
|---|---|---|---|
| 1,659,100 | 2/1928 | Hardage | 2/23 |
| 1,669,085 | 5/1928 | Guyon | 2/23 |
| 1,685,452 | 9/1928 | Goldsmith | 2/23 |
| 4,024,584 | 5/1977 | Smith | 2/24 |

*Primary Examiner*—Louis Rimrodt

*Attorney, Agent, or Firm*—Brady, O'Boyle & Gates

[57] ABSTRACT

Athletic pants of the type worn by football players include in each pant leg a frontal pocketed thigh pad and an adjacent independently pocketed pad to cover and protect the vastus lateralis. The hinged cooperative relationship of the two separate pads allows full leg flexure and freedom of movement without binding or discomfort. The added side pad also prevents excessive movement of the larger frontal pad and tends to hold the latter in its preferred position. The additional pad is easily installable on newly manufactured and existing pants at relatively minimal cost.

5 Claims, 9 Drawing Figures

FIG.1
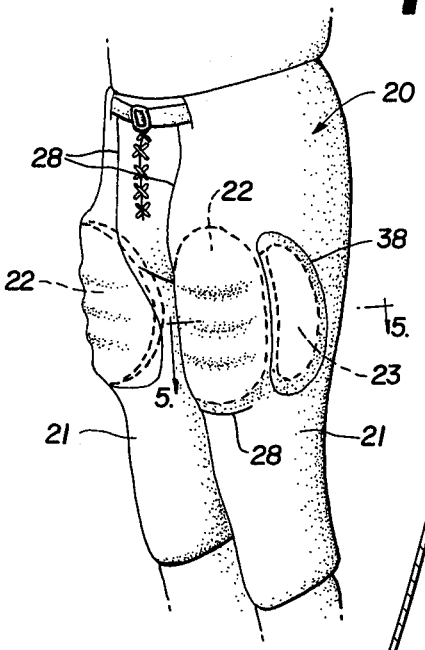
FIG.5
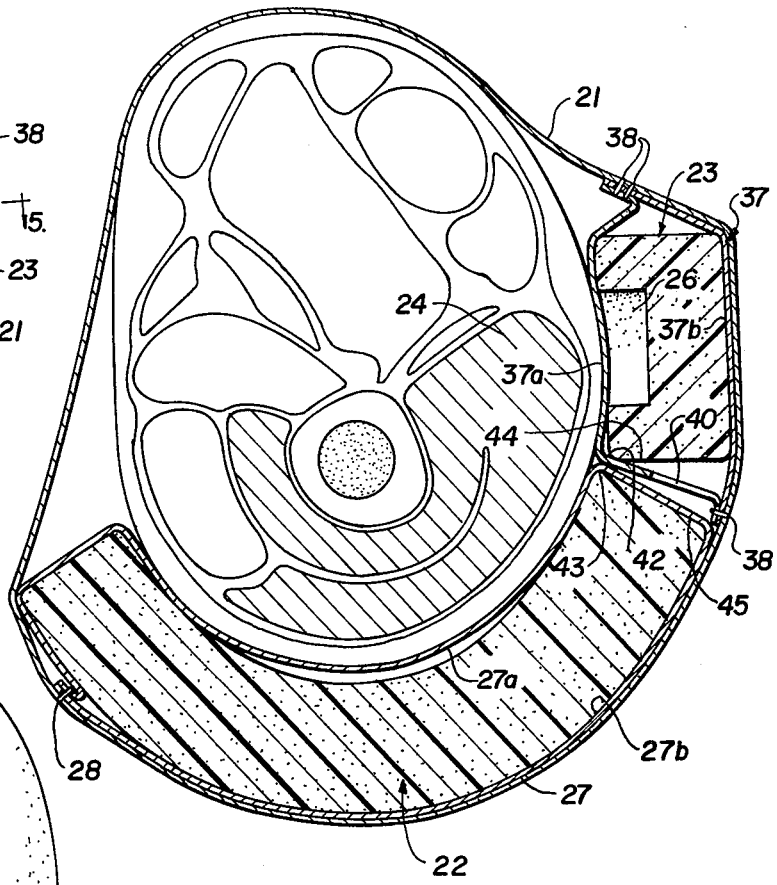
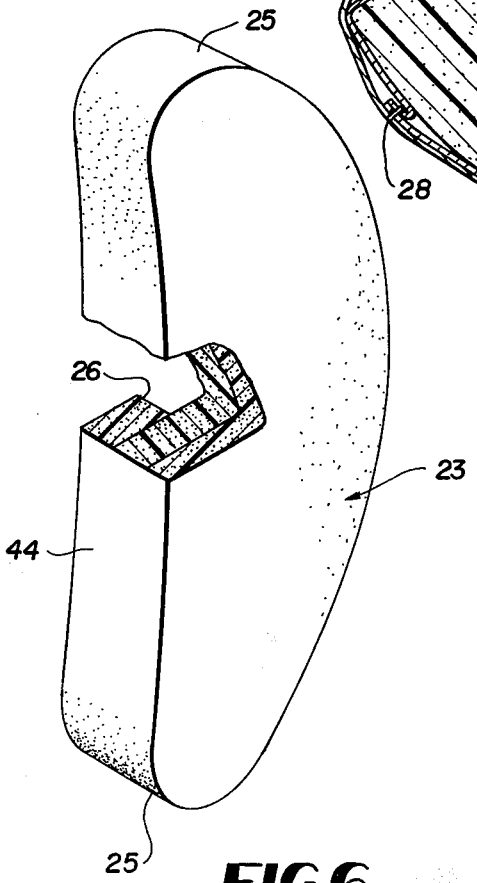
FIG.6
FIG.2
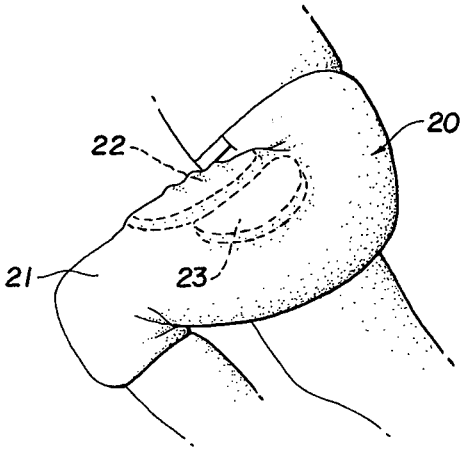

PROTECTIVE LEG PADDING FOR ATHLETIC PANTS

BACKGROUND OF THE INVENTION

The thigh pads of pants worn by present day football players afford adequate protection to the front of the thigh only and virtually no protection against blows received from the side or from an angle in the area of the vastus lateralis. The conventional thigh pads, which are quite thick, are premolded to fit the curvature of the leg at the front of the thigh. If the preformed pad is extended over the outer side of the thigh so as to cover or partly cover the vastus lateralis, its inherent stiffness will result in wearer discomfort and a considerable loss of leg and muscle mobility.

Another drawback of conventional football pants resides in the fact that considerable shifting of these pads in the customary oversize thigh pad pockets during play is inevitable, resulting in further loss of protection to the player and the necessity for frequent adjustment of the thigh pad during play, which is inconvenient and distracting.

The present invention seeks to improve the protection afforded by pants for football players and the like, and more particularly the invention seeks to provide a greatly improved padding system for the thighs of football players including an additional separately pocketed pad covering and protecting the vastus lateralis.

In carrying out the present invention, a structural arrangement is employed which does not require any significant change in the construction of the commonest types of football pants presently in use, the vastus lateralis pads being readily installable in either newly manufactured or existing pants with only minimum modification of the latter.

In addition to providing adequate protection for the vastus lateralis, in accordance with the main object of the invention, the separately pocketed side pads according to the invention provide the correlary benefit of tending to hold the frontal thigh pads in their preferred positions and minimizing "wandering" of these pads during play.

In the leg padding system of the present invention, a unique hinged relationship exists between the separately pocketed front and side pads, whereby they may hingedly adjust themselves automatically so as to conform to leg curvature in all positions of flexure of the leg, with complete comfort and without restricting leg movement. This important ability of the invention cannot be achieved by employing a single thigh pad which is extended around the side of the leg to the region of the vastus lateralis, as previously stated. The two protective pads utilized in the invention are capable, however, of adjusting themselves slightly with movements of the player's legs, and in response to blows received by the legs during play, due to the elasticity of the pants themselves and the material forming the pockets in which the pads are held.

Other objects and advantages of the invention will become apparent to those skilled in the art during the course of the following detailed description.

BRIEF DESCRIPTION OF THE DRAWINGS

FIG. 1 is a perspective view of padded athletic pants according to the present invention with the wearer in a relaxed standing position.

FIG. 2 is a perspective view of the pants with the wearer running.

FIG. 5 is an enlarged horizontal section through one pant leg and its padding system taken on line 5—5 of FIG. 1.

FIG. 6 is a perspective view, partly in section, of one side pad for the protection of the vastus lateralis.

DETAILED DESCRIPTION

Figure 3:
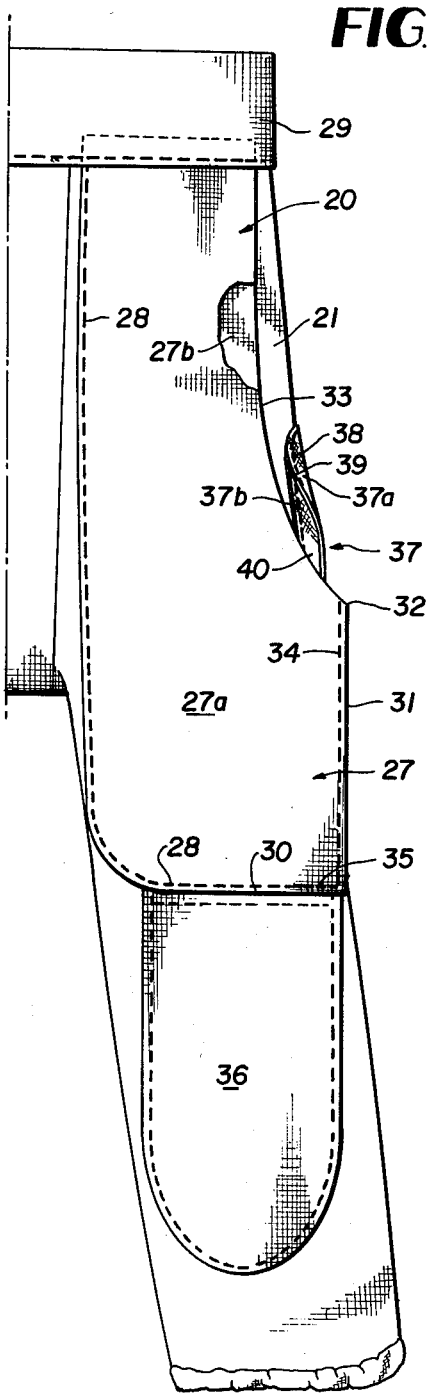
FIG. 3 is an interior front elevational view of one pant leg showing pocket structures for protective pads, the pant leg being turned inside-out.

Referring to the drawings in detail wherein like numerals designate like parts, the numeral 20 denotes a pair of pants for football players having a leg padding system in accordance with the present invention. The pants 20 in general are conventional and represent one of the most widely used commercial type. The pants 20 are formed of two-way stretch fabric in their entire shell or body portion. Each pant leg 21 includes a protective padding system consisting of the customary frontal thigh pad 22 and an adjacent independently held side pad 23 arranged particularly for the protection of the vastus lateralis muscle indicated at 24 in FIG. 5. Heretofore, pants equipped with frontal thigh pads only, such as the pads 22, have afforded no significant protection for the vastus lateralis.

As shown in the drawings, the frontal thigh pad 22 is a thick laterally curved pad of preset curvature which approximately matches the lateral curvature of the front of the thigh and spans the front of the thigh substantially completely. In its normal operational position, the frontal pad 22 does not overlie and protect the vastus lateralis, FIG. 5. The frontal pads 22 are substantially straight vertically and they may be laterally ribbed on their forward faces, as indicated in the drawings. They extend vertically from lower points somewhat above the knee to upper points near the elevation of the leg crotch.

The side pads 23 are comparatively much smaller than the frontal pads 22 and may be of substantially the same thickness as the frontal pads. They are preformed to lie substantially in a single flat plane when in a relaxed state. They are elongated in the vertical position of use and tapered substantially symmetrically toward opposite rounded ends 25. The side protective pads 23 are also somewhat crescent-shaped in side profile. Preferably, on its interior side, each pad 23 has a cavity 26 which is also tapered in opposite longitudinal directions and crescent-like, FIG. 8.

The frontal pads 22 which, per se, are conventional are held loosely in somewhat oversize fold-over thigh pad pockets 27, in accordance with one of the most widely used commercial form of football pants. The pockets 27 may be formed of two-way stretch fabric. Each pocket 27 is stitched to the outer shell of the adjacent pant leg 21 by a vertical line of stitching 28 which descends from the waistband 29 of the pants to the level of the bottom of the thigh. At this level, the line of stitching extends horizontally across the pant leg and preferably terminates at a point approximately located at 30 short of the other vertical edge 31 of the thigh pad pocket 27. This vertical edge 31 of the pocket 27 rises to and terminates at a point 32, somewhat less than one-half the height of the entire pocket structure. From this point up to the waistband 29, the outer side of the pocket 27 is open along a gradually curved line 33. The pocket 27 includes inner and outer pockets 27*a* and 27*b*, shown in FIG. 5, and these pocket walls are connected around the perimeter of the pocket by the line of stitching 28 and by cooperative lines of stitching 34 and 35, the latter line of stitching 35 comprising an extension of the line of stitching 28 beyond the point 30. It will be understood that the pocket 27, therefore, is attached to the pant leg shell 21 by the line of stitching 28 extending from the waistband 29 along the inner side of the pocket vertically, and then horizontally or laterally to the point 30.

Beyond this point, FIG. 3, the entire outer vertical edge portion of the pocket 27, including its open edge 33, is unattached to the pant leg shell 21. The reason for this in the conventional football pants 20 is so that the pocket 27 can be folded over longitudinally from its free edge 31 to the attachment point 30 along the entire height of the pocket structure. This, in turn, enables attachment of exterior decorative team identifying braid to the sides of the pant legs along the vertical side seams 36 without stitching the pocket 27 closed in the process. In this connection, it is also commmon practice to employ the identical football pants for practice pants and for game pants, the only difference being that the practice pants do not carry the decorative identifying braid. The thigh pad pocket 27 below its lower closed edge defined by the lines of stitching 28 and 35 may also carry a free-hanging knee pad pocket 36 as best shown in FIG. 3.

Figure 4:
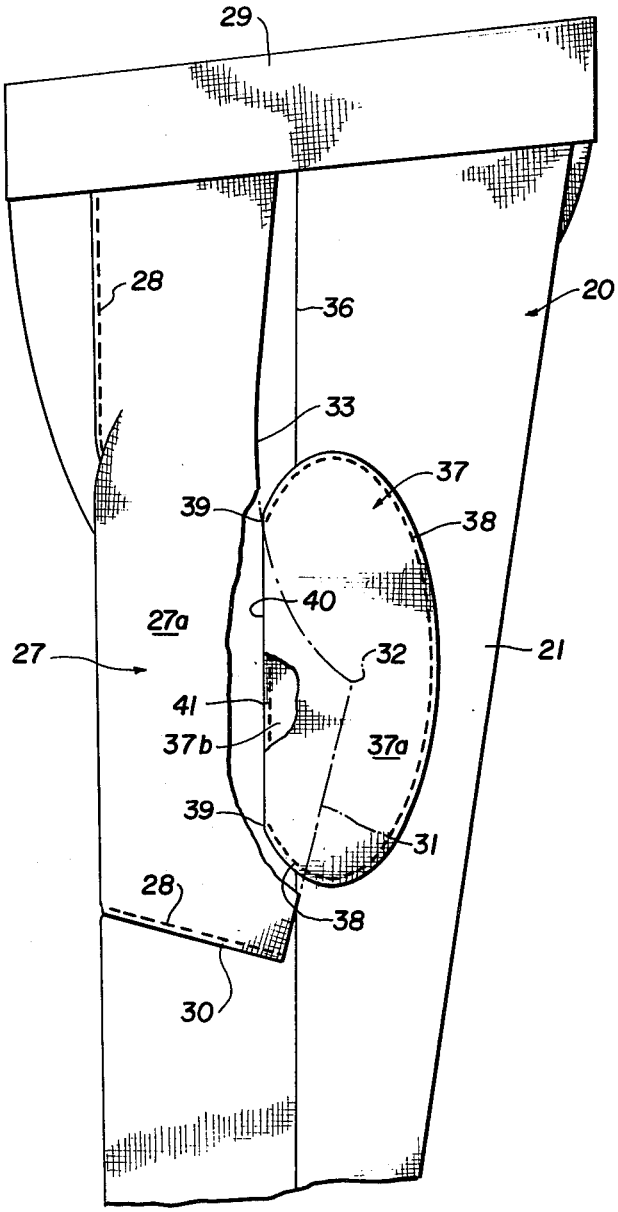
FIG. 4 is a similar view of the pocket structure in side elevation taken at right angles to FIG. 3.

While the above-described construction of the frontal thigh pad pocket 27 is entirely conventional, it is necessary to understand its construction for a full understanding of the invention and its several advantages. Each separate side pad 23 for the protection of the vastus lateralis is held in a pocket 37 closely adjacent to the outer vertical side of the pocket 27. The pocket 37 which is also crescent-like and vertically elongated is attached to the shell of pant leg 21 by a continuous line of stitching 38 having terminal points 39 substantially in vertical alignment. The line of stitching 38 extends around the top and bottom curved ends of the pocket 37, FIG. 4, and then descends and rises to the two points 39 to give to the pocket 37 a generally straight vertical opening between the two points 39 indicated by the numeral 40. The pocket 37 possesses inner and outer walls 37*a* and 37*b*. Along the opening 40, FIG. 4, only the wall 37*b* is attached to the pant leg shell 21 by a vertical continuation 41 of the line of stitching 38.

Figure 9:
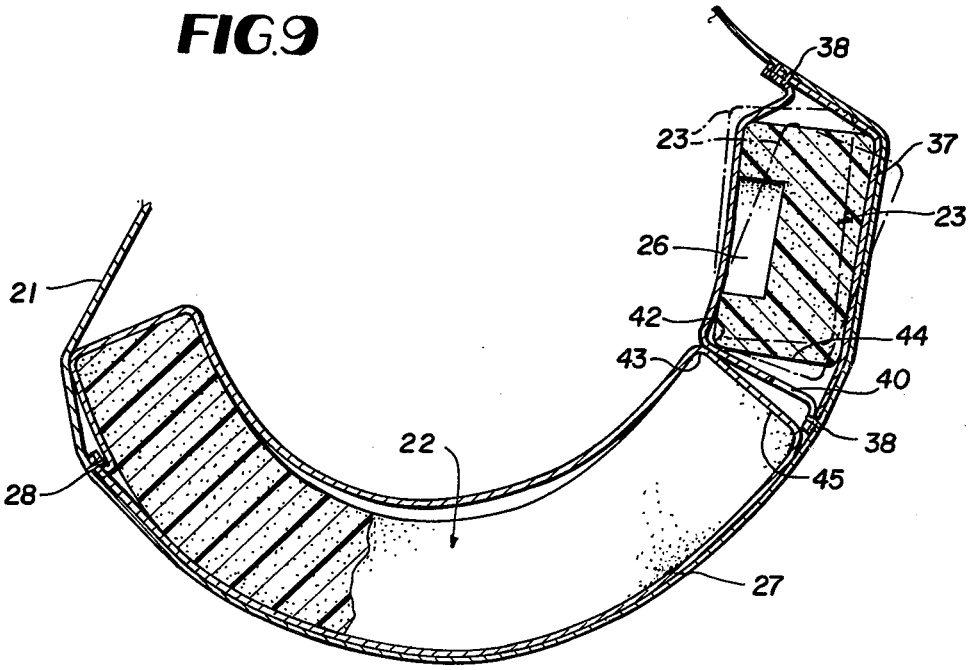
FIG. 9 is a fragmentary section similar to FIG. 5 depicting relative hinging movement of the two pads according to the invention.

The conventional laterally curved frontal thigh pad 22 is received loosely in the pocket 27, it being introduced into the pocket through the long opening 33. The smaller flat side pad 23 is received snugly or tightly within the pocket 37, the two-way stretch fabric of this pocket being stretched to allow entry of the pad 23 through the opening 40. When the two pads 22 and 23 are assembled in the pockets 27 and 37, they possess a unique cooperative relationship having several advantages. When the pants are donned by the athlete, they are very tight fitting and the stretch fabric making up the pant legs 21 as well as the two pockets 27 and 37 is tensioned in all directions as shown best in FIGS. 5 and 9. In this condition, the two adjacent interior vertical corners 42 and 43 of the pads 22 and 23 are substantially in abutment through the stretch material of their pockets and the adjacent side vertical edges 44 and 45 of the two pads diverge outwardly away from the side of the leg. The smaller pad 23 is positioned directly opposite the vastus lateralis and substantially along the length of this muscle vertically. The relatively straight vertical edge 44 of the side pad 23 is then extending along and roughly parallel to the adjacent generally vertical edge of the frontal thigh pad 22.

Because of the contact of the pad corners 42 and 43, the two pads 22 and 23 can have restrained hinged movement relative to each other along a substantially vertical hinge axis defined by the corners 42 and 43. Such hinged movement between the two pads is graphically shown in FIG. 9 in relation to the side pad 23. In this figure, the pad 23 in phantom lines is shown in two approximate extremes of hinged movement relative to the frontal pad 22 and relative to a neutral or normal position of the pad 23 shown in full lines in cross section in FIG. 9. It will be understood that in reality, as the player's leg flexes and assumes various positions during play and as the player's leg receives both frontal blows as well as side and angle blows, the two pads 22 and 23 will move on the common vertical hinge axis, one relative to the other in various degrees and in various ways. The stretch fabric also permits small movements of the two pads in their pockets under impact independently.

Another important benefit derived from the described construction and arrangement of the two pads 22 and 23 and their pockets is the fact that the side pad 23 which is tightly held in its pocket 37 tends to hold or lock the frontal pad 22 in its preferred position and prevents wandering of this pad and the necessity for frequently re-aligning it, by exerting constant side pressure on the pad 22. The ability of the two pads to hinge freely along the vertical axis is a very key feature of the invention rendering it practical and effective, it having been explained previously that a mere extension of the frontal pad to a position adjacent to the vastus lateralis will not work properly because of restricting leg movements and causing discomfort to the wearer. At all times and in all positions of the leg, the side pad 23 remains in protective relationship to the vastus lateralis.

Figure 7:
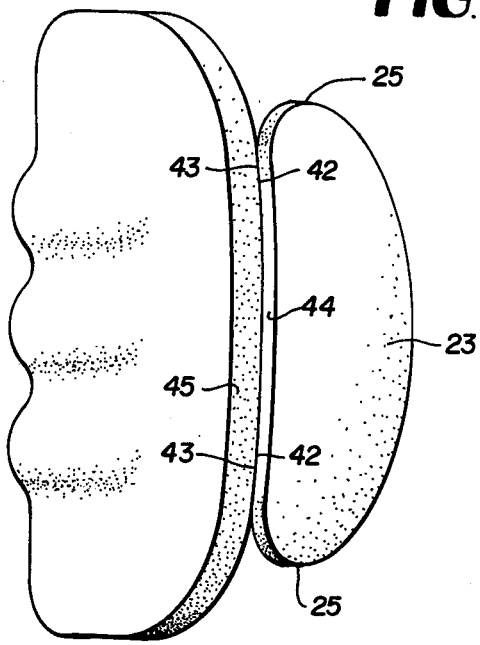
FIG. 7 is an exterior perspective view of the two pads employed in the padding system without their pocket means.
Figure 8:
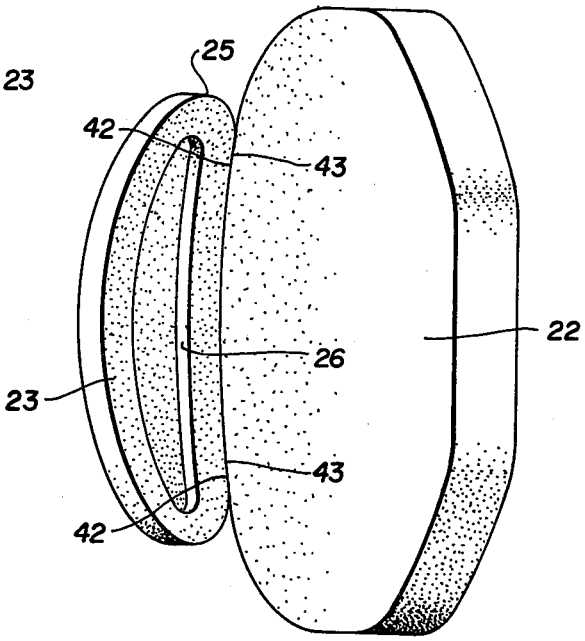
FIG. 8 is an interior perspective view of the two pads.

FIGS. 7 and 8 show the two coacting pads 22 and 23 without their containing pockets and without the shell of the pants. These FIGURES depict the comparatively straight edge 44 of the side pad 23 extending along the roughly parallel vertical edge 45 of the frontal pad 22. The relative engagement of the corners 42 and 43 of the two pads is also shown in FIGS. 7 and 8, which engagement establishes the described approximately vertical hinge axis of the pads. FIG. 7 depicts this from the exterior of the two pads whereas FIG. 8 depicts the condition as it appears looking at the interiors of the two pads.

It may be seen that, through a very simple structural addition, the football pants are rendered more effective in several important aspects as completely described above. The invention is applicable to both new and existing pants of the commonest type now in use with only minimal increase in cost. Serious injuries involving the vastus lateralis are greatly minimized. Indirectly, the use of the pad 23 lessens strain on the knee joint resulting from side impacts against the thigh, because the additional pad 23 absorbs much of the initial impact rather than transmitting it to the knee joint.

The invention is not restricted to the addition of a single side pad to the pant legs, and in some cases, several pockets and pads may be provided around the leg in the thigh region and/or along the length of the leg to meet the preferences of athletes. The described arrangement also renders removal of the side pad 23 should this be desired without difficulty. When this is done, the frontal pad 22 and its pocket 27 remains unchanged from the prior art arrangement.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. Athletic pants for football players comprising a fabric body portion having legs, a first fabric pocket attached to the interior of each leg in the frontal thigh region, a permanently laterally curved frontal thigh pad held within the first pocket and substantially conforming to the natural lateral curvature of the front of the thigh and spanning substantially the entire front of the thigh to protect it from frontal blows, a second fabric pocket attached to the interior of each leg adjacent to the vastus lateralis, a side pad having substantially the same thickness as the frontal thigh pad held in the second pocket and covering and protecting the vastus lateralis from angle blows and side blows, the frontal thigh pad and side pad having opposing closely adjacent substantially vertical edge faces which diverge outwardly from the interior faces of said pads and define with the interior faces substantially square interior vertical corners, said corners being substantially in abutting relationship through the fabric of said pockets to define a substantially vertical hinge axis for said pads, whereby the pads can conform to the natural contours of a wearer's leg in various positions of flexure of the leg substantially without restricting leg flexure.

2. Athletic pants for football players as defined in claim 1, and said first and second fabric pockets being formed of stretch fabric and said pads being snugly held in said pockets and the pads and pockets being snugly held by the fabric body portion in contact with the leg of a wearer of the pants, whereby said side pad may freely adjust itself angularly on said hinge axis while simultaneously resisting lateral displacement of said frontal thigh pad.

3. Athletic pants for football players as defined in claim 2, and said side pad having an interior side cavity extending for a substantial portion of the length and width of the side pad.

4. Athletic pants for football players as defined in claim 1, and the frontal thigh pad comprising a relatively wide pad in its direction of lateral curvature and being elongated in the vertical direction, the side pad being comparatively narrow laterally and being generally flat and tapering toward its top and bottom ends.

5. Athletic pants for football payers as defined in claim 4, and said second pocket being shaped to substantially match the marginal contour of the side pad which it snugly holds and having a restricted opening in the side wall thereof opposing the first pocket through which the side pad is introduced into and removed from the second pocket.

* * * * *